US007179020B2

(12) United States Patent
Robertson, Jr.

(10) Patent No.: US 7,179,020 B2
(45) **Date of Patent: *Feb. 20, 2007**

(54) MINE ROOF BOLT ANCHORING SYSTEM AND METHOD

(76) Inventor: Roy Lee Robertson, Jr., P.O. Box 493, Delbarton, WV (US) 25670

( * ) Notice: Subject to any disclaimer, the term of this patent is extended or adjusted under 35 U.S.C. 154(b) by 0 days.

This patent is subject to a terminal disclaimer.

(21) Appl. No.: 11/240,325

(22) Filed: Sep. 30, 2005

(65) Prior Publication Data

US 2006/0018721 A1 Jan. 26, 2006

Related U.S. Application Data

(63) Continuation-in-part of application No. 10/730,670, filed on Dec. 8, 2003, now Pat. No. 6,986,623.

(51) Int. Cl.
*E21D 21/00* (2006.01)

(52) U.S. Cl. ..... 405/259.4; 405/259.6; 405/288; 405/302.1

(58) Field of Classification Search ..... 405/259.1, 405/259.4, 259.5, 259.6
See application file for complete search history.

(56) References Cited

U.S. PATENT DOCUMENTS 4,173,918 A * 11/1979 Piersall ..... 411/51
4,413,930 A * 11/1983 Calandra ..... 405/259.6
4,419,805 A 12/1983 Calandra, Jr.
4,516,886 A 5/1985 Wright
4,557,631 A 12/1985 Donan, Jr. et al.
4,564,315 A 1/1986 Rozanc
4,626,139 A 12/1986 Blackwell
4,664,561 A 5/1987 Frease
4,704,053 A 11/1987 Hipkins, Sr. et al.
4,784,530 A 11/1988 Price, Jr.
4,848,971 A * 7/1989 Price Jr. ..... 405/259.3
5,042,961 A 8/1991 Scott et al.
5,064,311 A 11/1991 Giroux et al.
5,073,065 A 12/1991 Kleineke
5,184,922 A 2/1993 Blackwell
5,203,647 A 4/1993 Blackwell
5,219,248 A * 6/1993 Wright ..... 405/259.4
5,232,311 A * 8/1993 Stankus ..... 405/259.6

(Continued)

*Primary Examiner*—Frederick L. Lagman
(74) *Attorney, Agent, or Firm*—Waters Law Office, PLLC; Robert R. Waters; Brian W. Foxworthy

(57) ABSTRACT

An improved mine roof bolt is disclosed. The mine roof bolt comprises a bolt portion having a threaded end, a slidable camming nut, a stop, and an expansion shell having a central threaded nut with wedge fingers extending from it. The camming nut is fitted into the expansion shell which is threaded onto the threaded section of the bolt. Turning the bolt while it is in a hole causes the expansion shell to move along the bolt and carry the camming nut to the stop located on the bolt, and this causes the wedge fingers to engage with the camming nut, spreading the wedge fingers into contact with the hole sides. As the turning of the bolt continues, the relative movement of the camming nut and wedge fingers increases the wedging effect within the hole until the bolt is anchored in the hole. While turning of the bolt may serve to mix a catalytic adhesive, the adhesive is not needed to activate the mechanical anchoring mechanism of the mine roof bolt.

18 Claims, 9 Drawing Sheets

U.S. PATENT DOCUMENTS 5,244,314 A * 9/1993 Calandra et al. ..... 405/259.4
5,501,551 A 3/1996 Wright
5,885,031 A 3/1999 White
6,146,055 A 11/2000 White
6,474,910 B2 * 11/2002 Lay ..... 405/259.4
6,742,966 B2 * 6/2004 Cook ..... 405/259.6
6,986,623 B2 * 1/2006 Robertson, Jr. ..... 405/259.4

* cited by examiner

MINE ROOF BOLT ANCHORING SYSTEM AND METHOD

RELATED U.S. APPLICATION DATA

This application is a continuation-in-part of U.S. patent application, Ser. No. 10/730,670, filed on Dec. 8, 2003 and since issued as U.S. Pat. No. 6,986,623. This application relates to a method and apparatus for anchoring a mine roof bolt. The entire disclosure contained in U.S. application Ser. No. 10/730,670 and its resulting patent U.S. Pat. No. 6,986,623, including the attachments thereto are incorporated herein by reference.

FIELD OF THE INVENTION

This invention relates generally to an apparatus and method for anchoring devices in rock material. More specifically, it relates to mine roof bolts and methods of using them to support the rock layer exposed in mine roofs by drilling holes in the roofs and mechanically and adhesively anchoring the bolts to higher layers of rock.

BACKGROUND OF THE INVENTION

Mine shafts sometimes experience cave-ins, collapses, or falling rock due to the layered and stratified makeup of the earth. A mine shaft itself may cause fractures and weaknesses in a strata in its ceiling, or it may just expose an inherently weak and unstable layer. To assist in preserving the integrity of the ceiling, it is common to support the ceiling with bolts anchored up rock layers above the ceiling. Plates between the bolt heads on the exposed ends of the bolts and the ceilings are used to transfer force from the anchored bolts to the exposed layer of the ceiling. In some applications, the exposed end of the anchored bolt is threaded. Onto these bolts, a nut is threaded, and the nut is used to place a preload on the bolt to set an initial lifting force to the plates.

Holes, which are slightly oversized to the bolts, are drilled into the ceiling. Sometimes the holes must be several feet deep to be sure of anchoring the bolts in a stable layer of rock. Once the holes are drilled, the bolts are inserted into the holes and anchored. There are three methods for anchoring the bolts in the holes, mechanical, adhesive, and mechanically assisted adhesive. This patent relates mostly to the mechanical method or the mechanical aspect of the mechanically assisted adhesive method of anchoring bolts, so the adhesive method will be discussed only briefly before discussing the relevant mechanical art.

Once the hole is drilled, a multi-component adhesive is placed in the blind end of the hole. The components of the adhesive are kept in separate frangible packages to keep them from mixing, for once they do, a reaction occurs, and the adhesive begins to set up. The components of the adhesive are usually a hardener and a catalyst. When the frangible packages have been placed in the hole, a bolt is inserted and turned rapidly to rupture the packages and thoroughly mix the adhesive components. The adhesive is typically of a fast setting variety and may begin to set after three to five seconds of mixing. For many mechanical anchoring methods, the mechanical anchoring elements on the bolt assist in mixing the adhesive, and the increased resistance to mixing of the setting adhesive activates the mechanical anchoring system.

DESCRIPTION OF THE RELATED ART

A very common mechanical anchoring system is shown in U.S. Pat. No. 4,419,805 by Calandra, Jr. This system comprises, basically, a bolt with a threaded end, a camming nut having through its axis a threaded hole to match the bolt, a wooden dowel, and an expansion shell. The camming nut has several sides, the sides being at an angle to the axis of the camming nut to create a wedge effect so that one end of the camming nut is larger than the other. Also, the camming nut has a hole through it transverse to the axis of the camming nut. The diameter of this transverse hole and that of the wooden dowel pin match each other with the length of the dowel pin matching the length of the transverse hole. The expansion shell has at one end a solid ring. The inner diameter of this ring is slightly larger than the bolt diameter. From this ring, several wedge fingers extend in a direction parallel to the axis of the hole. These fingers are equal in number to the sides of the camming nut and, having a wedge shape, taper as they extend away from the ring.

In operation, the expansion shell is placed over the bolt with the tapered wedge fingers pointing up. The wooden dowel is put through the hole in the camming nut, and the camming nut screwed onto the bolt until the dowel pin stops the bolt from passing any further into the camming nut. The expansion shell is pushed up onto the camming nut with the wedge fingers of the expansion shell aligning with the tapered sides of the camming nut. When an anchor hole has been drilled and filled with the adhesive pouches, the bolt is inserted into the hole and turned rapidly to rupture the pouches and mix the adhesive components. The anchoring components on the bolt serve to mix the adhesive. The rapidly setting adhesive provides resistance to the turning of the anchoring elements until the resistance is great enough to cause the bolt shaft to shear the wooden dowel in the camming nut. Once that occurs, the threads begin to pull the camming nut further onto the bolt and into the wedge fingers of the expansion shell. As the camming nut advances into the expansion shell, the wedge fingers are expanded out to wedge in the wall of the anchor hole. The wedging of the expansion shell should stop the turning of the bolt before the adhesive sets. Otherwise, as the adhesive sets, a still turning bolt will cause the adhesive to set as small discrete particles as opposed to a single homogeneous anchor. Once the mechanical anchor is set, the bolt can have a preload placed on it. If a mechanical anchor is not used, an operator must wait until the adhesive sets to preload the bolt. So, while the adhesive provides the strongest anchor, the mechanical anchor makes the bolt system more time efficient and therefore more economical.

An additional feature in Calandra, Jr. is the use of a washer to contain the adhesive after the frangible pouches are ruptured and the adhesive is mixed. The washer has an inner diameter closely matching the bolt diameter and an outer diameter approximating that of the hole. It is located below the anchor elements at a position that keeps the adhesive contained in a small enough volume that the adhesive essentially fills the volume. The washer may be fixed in position by a press fit on the bolt or it may be welded in place.

Another common type of mechanical anchor used in mine bolts is the bail type anchor. It has a tapered camming nut and tapered wedge fingers as described above, but the tapered wedge fingers are connected to each other at their thinner upper end by a bail. The bail passes up along the outside of the camming nut and across the top of the camming nut at its wider end. A groove in the camming nut allows the bail to stay within the profile of the camming nut, and in most of these bail type anchors, the wedge fingers are not connected by a ring at their thicker end. In this type of anchor, the resistance of the adhesive causes the camming nut, wedge fingers, and bail to turn more slowly than the bolt, so the bolt begins to advance up through the camming nut until it contacts the bail across the top of the camming nut. At that point, the bolt begins to lift the bail off of the top of the camming nut, and the bail then begins to pull the tapered wedge fingers up toward the camming nut. As the tapered wedge fingers and camming nut become more engaged, the wedging effect between the camming nut, tapered wedge fingers, and the hole sides increases. The bail may break once the camming nut and tapered wedge fingers are sufficiently wedged, if the bolt continues to advance through the camming nut. Once the mechanical anchor is set, a preload is placed on the bolt. Subsequently, the resin fully sets.

Many inventions in this field are directed to additional means for mixing the adhesive as well as the anchoring mechanism. U.S. Pat. No. 4,516,886 by Wright features a bail type anchor that has a two part bail to improve the mixing of the adhesive components. In addition to the bail that passes directly over the camming nut, a second bail extends above the camming nut, effectively providing an elongated hoop to puncture the component pouches and mix the adhesive. The bail that runs directly across the top of the camming nut has a hole through it slightly smaller than the bolt hole in the camming nut. The resistance of the adhesive causes the bolt to force its way through the first bail and advance through the camming nut until the bolt reaches the extended bail which begins to pull the tapered wedge fingers into wedging action with the camming nut and hole sides. Other patents add different mixing means. U.S. Pat. No. 5,042,961, by Scott, fixes a helix shaped length of wire to the bolt below the wedging mechanism, while U.S. Pat. No. 5,073,065, by Kleineke, places an adhesive mixing and retention washer on a tapered shoulder below the anchoring mechanism.

The use of the setting adhesive to drive the wedging action of the mechanical portion of the various anchoring systems has severe drawbacks. Obtaining complete mechanical engagement before the adhesive sets is very time dependent. Variations in the mechanical components, in particular, may prove problematic. The strength of wood shear pins may vary widely. If a sheer pin does not break and the expansion shell is still turning as the adhesive sets, the adhesive may set as small disassociated particles as previously discussed. Once that occurs, the resulting adhesive gravel may provide enough resistance to activate the mechanical anchor, and the bolt may still anchor mechanically. However, the adhesive anchor is lost and it is the adhesive anchor that provides the majority of the long term strength of the anchoring system. This is particularly dangerous since the bolt appears to be anchored, but the superior long term anchor of the adhesive component has been lost. Because of the appearance of a good anchor, remedial measures such as placing another bolt immediately nearby are not undertaken. The resulting weakly anchored roof bolt is often called a "spinner" in the mining industry.

Occasionally, if it is obvious to an operator that a mechanical anchor is not actuating, the operator may pause long enough for the resin to nearly set, and then resume turning the bolt. This brings about the destruction of the adhesive, but will pull the bolt up tight for a preload and will give the appearance of a successful anchoring. However, the actual result is a "spinner".

Some types of rock are particularly soft. This, too, is a problem. The mechanical anchor may widen the hole as it turns and fail to pull tight within the hole. If it continues to turn in a loosened hole, again, the adhesive is at risk.

Another problem is more specific to the mechanical elements of the anchoring systems that use expansion shells having the tapered wedge fingers joined by a common ring at the base with a camming nut being drawn into the expansion shell. These systems typically have four sides on the camming nut and four tapered wedge fingers on the expansion shell with each tapered wedge finger being driven out to the hole wall by a corresponding camming nut side. Sometimes the camming nut will turn within the expansion shell, twisting the wedge fingers to an angle about the axis of the bolt and preventing an effective anchoring in the hole. Again, this substantially decreases the overall holding power of the bolt, allowing ceiling collapses where the load exceeds the strength of the anchor.

SUMMARY OF THE INVENTION

The present invention is an improved mine roof bolt having a main bolt shaft with a threaded end, a fixed camming nut, and threaded expansion shell. It has a more easily activated mechanical anchor and an overall simpler design than the prior art.

Accordingly, it is a primary objective of this invention to improve mine safety by decreasing the rate of occurrence of "spinners" in mine roof bolts.

It is a further objective of this invention to provide a mine roof bolt with a mechanical anchoring system that is not dependent on a setting adhesive for activation.

It is also an objective of this invention to provide a mine roof bolt that is easier to anchor in a receiving bolt hole.

It is a another objective of this invention to provide a mine roof bolt that has fewer moving parts in the mechanical anchoring system.

It is a still further objective to provide a mine roof bolt which decreases the occurrence of twisting of the expansion shell.

It is yet another objective of this invention to provide a mine roof bolt system that does not use a shear pin such as the wooden dowel discussed above in the relevant art.

It is still yet another objective of this invention to provide a mine roof bolt that can be used without an adhesive altogether.

It is still yet a further objective of this invention to provide a mine roof bolt having a built in timer function.

As discussed above, the article of the present invention overcomes the disadvantages inherent in prior art methods and prior art devices for anchoring a mine roof bolt. In this respect, before explaining at least one embodiment of the invention in detail, it is to be understood that the invention is not limited in its application to the details of construction and/or to the arrangement of the support structure set forth in the following description or illustrated in the drawings. The invention is capable of other embodiments and of being practiced and carried out in various and diverse ways. Also, it is to be understood that the phraseology and terminology employed herein are for the purposes of description and should not be regarded as limiting.

Accordingly, those skilled in the art will appreciate that the concept upon which this invention is based may readily be utilized as a basis for the design of other structures, methods, and systems for carrying out the purposes of the present invention. It is important, therefore, that the claims be regarded as including such equivalent constructions insofar as they do not depart from the spirit and scope of the present invention.

Furthermore, the purpose of the foregoing Abstract is to enable the U.S. Patent and Trademark Office and the public generally, and especially including the practitioners of the art who are not familiar with patent or legal terms or phraseology, to determine quickly from a cursory inspection, the nature and essence of the technical disclosure of the application. The Abstract is neither intended to define the invention of the application, nor is it intended to be limiting to the scope of the invention in any respect.

BRIEF DESCRIPTION OF THE DRAWINGS

Additional utility and features of this invention will become more fully apparent to those skilled in the art by reference to the following drawings, wherein all components are designated by like numerals and described more specifically.

FIG. 12 shows a bolt portion of a mine roof bolt system having different diameters with a tapered section in between.

DETAILED DESCRIPTION OF PREFERRED EMBODIMENT

Figure 1:
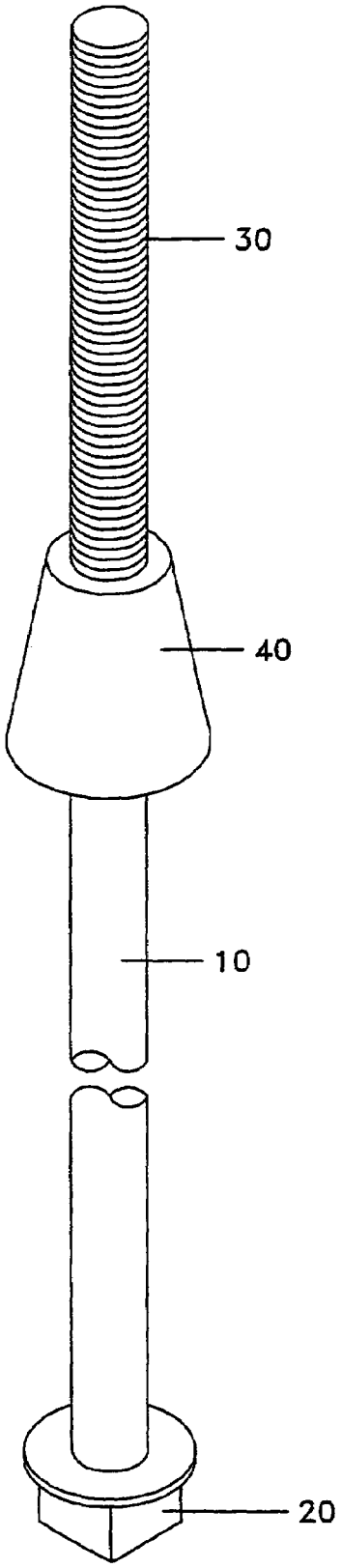
FIG. 1 is an isometric view of the bolt portion of an embodiment of the invention.
Figure 2:
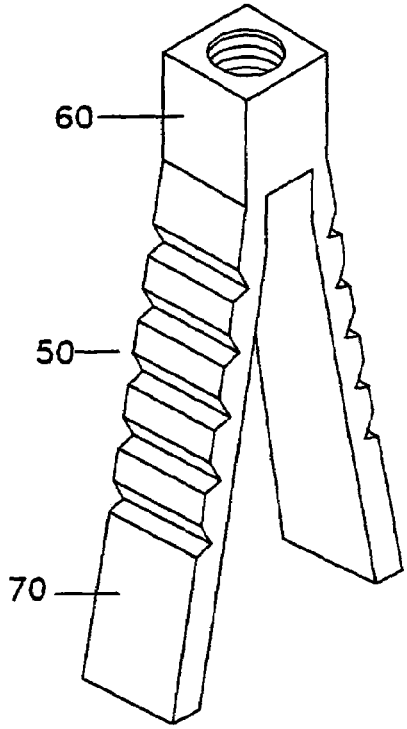
FIG. 2 is an isometric view of the expansion shell portion of an embodiment of the invention.
Figure 3:
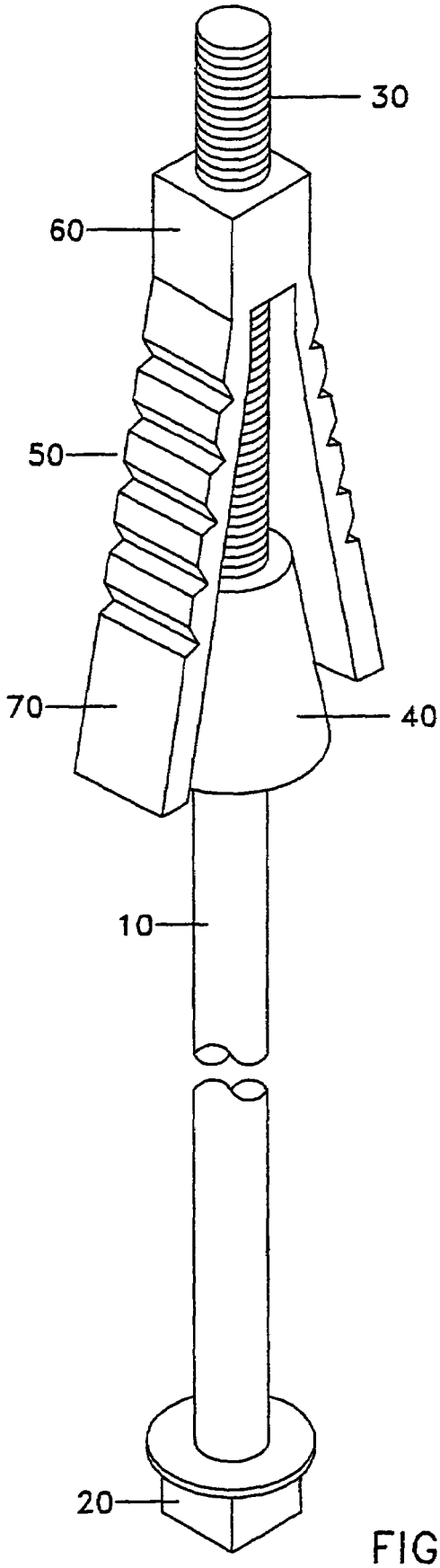
FIG. 3 is an isometric view of the bolt portion and expansion shell portion assembled.
Figure 4:
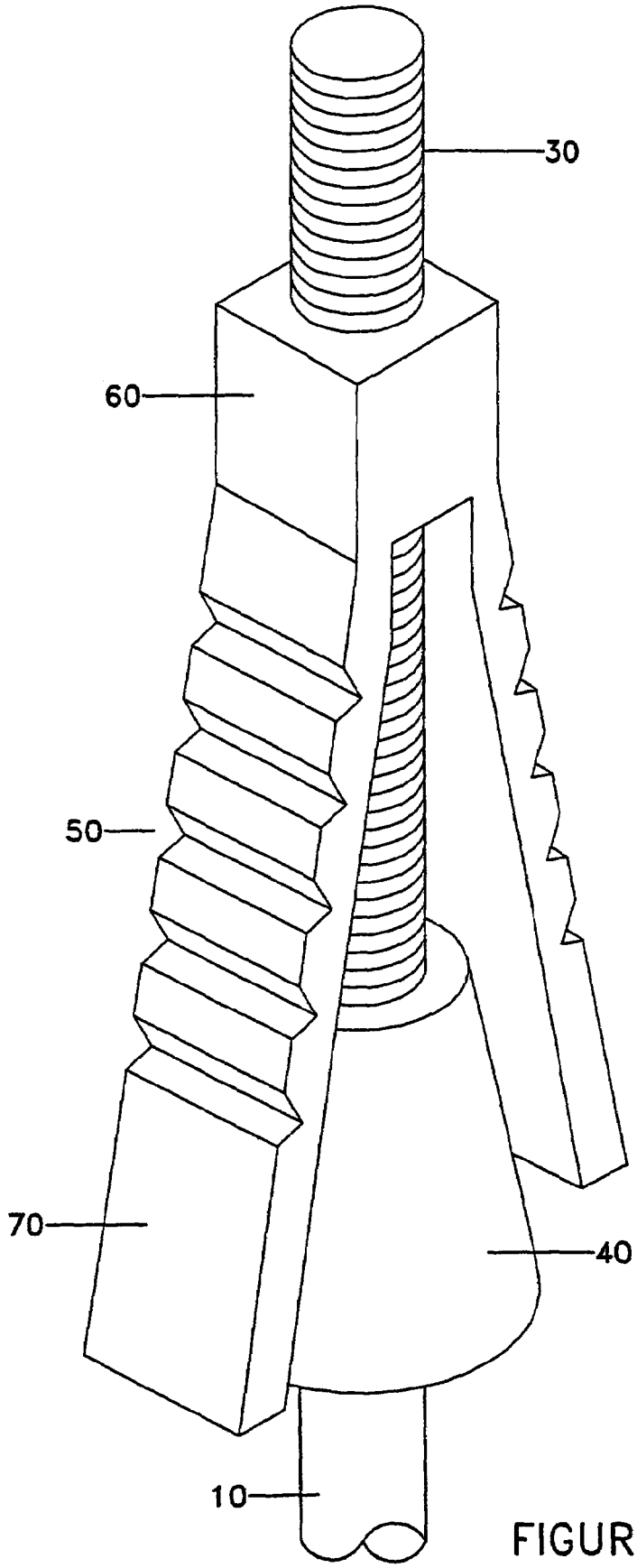
FIG. 4 is an enlarged isometric view of the working parts of an embodiment of the invention.

The following discussion illustrates only some of the possible configurations claimed in this invention and should not be interpreted as limiting the scope of the claims. FIG. 1 depicts the bolt portion 10 of the mechanical anchoring system. The bolt has a means for turning it 20 via a driver or wrench on one end, machine threads 30 on the other end, and a camming nut 40 fixed on the shaft of the bolt 10 at a position nearer to the machine threads 30. FIG. 2 shows an expansion shell 50 having as its central component a threaded nut portion 60, and at least two, in this case two, wedge fingers 70 extending from the threaded nut portion 60 in a direction essentially parallel to the axis of the hole through the threaded nut portion 60. FIG. 3 shows the expansion shell 50 threaded onto the machine threads 30 of the bolt portion 10 with the wedge fingers 70 directed towards the camming nut 40.

To use the bolt assembly 80, it is inserted into a drilled hole in the roof of a mine shaft until the load bearing plate contacts the mine roof. The bolt 10 is turned while the expansion shell 50 is kept from rotating, either by contact of the wedge fingers 70 with the sides of the hole or by a setting adhesive, which has previously been placed in the hole and is mixed by the expansion shell and bolt. This pulls the expansion shell 50 along the machine threads 30 of the bolt 10 towards the conical camming nut 40. As this continues, the wedge fingers 70 of the expansion shell 50 are driven out into contact with the hole sides by the camming nut 40. Once the resistance between the hole sides and the wedge fingers 70 is greater than the resistance between the wedge fingers 70 and the camming nut 40, the bolt assembly 10 will be pulled into the hole more than the expansion shell 50 will be pulled along the bolt 10. This may occur relatively quickly if the wedge fingers 70 are so shaped that the ends anchor into the sides of the wall without being spread by the camming nut 40.

As has been discussed, an adhesive is frequently used in the anchoring process. The adhesive is contained in pouches which are placed in the hole before the bolt is inserted. Because the expansion shell 50 may be placed at the leading end of the threaded section 30 of the bolt portion 10, it may be necessary to shape the threaded nut portion 60 of the expansion shell 50 in such a way that the adhesive can flow past it when the mechanical anchor is inserted into the hole. As one example, if the expansion shell 50 has two wedge fingers 70, the threaded nut portion 60 can have a flattened shape wherein the wedge fingers 70 attach at the narrower sides. The flattened shape would create greater clearance between the threaded nut portion 60 and the sides of the hole, allowing adhesive to flow past the threaded nut portion 60 as the mechanical anchoring system is inserted into the hole. As another example, if an expansion shell 50 has three wedge fingers 70 attached to it, the threaded nut portion 60 could have a clover leaf shape wherein the wedge fingers 70 attach at the lobes of the clover leaf and the adhesive could flow past the threaded nut portion 60 through the interstices, or notches, between the lobes. Configurations with additional wedge fingers 70 would require other, perhaps similar, shapes.

The camming nut 40 may be fixed in its linear position in various ways and may also vary in its shape. If it is round, like a cone, it can have a rotational motion relative to the wedge fingers 70 and may be fixed to the shaft of the bolt portion 10 of the mechanical anchoring system. One means of doing this is to have machine threads internal to the camming nut 40 which match those of the machine threads 30 of the bolt portion 10. The camming nut 40 can then be screwed down to where the machine threads 30 end, thus fixing the linear and angular location of the camming nut 40. Other means of so fixing the camming nut 40 include crimping the camming nut 40 onto the bolt portion 10 of the mechanical anchoring system or welding the camming nut 40 to the bolt portion 10. If the bolt portion 10 has a larger diameter tapering down to a smaller diameter for the machine threads 30, then the camming nut 40 may be linearly located merely by it having an inner diameter sized between that of the machine threads 30 and the bolt portion 10 and being slid over the machine threads 30 to the taper section.

If it is desired that the camming nut 10 not have any rotational motion with respect to the expansion shell 50, it may be held in its linear location by a support washer and allowed to spin on the bolt portion 10. This is particularly desirable if the camming nut 10 is not round like a cone but instead has flat sides tapering from a large end to a smaller end to engage the wedge fingers 70. Such a support washer could be fixed in its linear position in many of the ways already discussed for the camming nut 40 such as internal threads, crimping or press fitting, welding, and a tapered shaft section.

Figure 8:
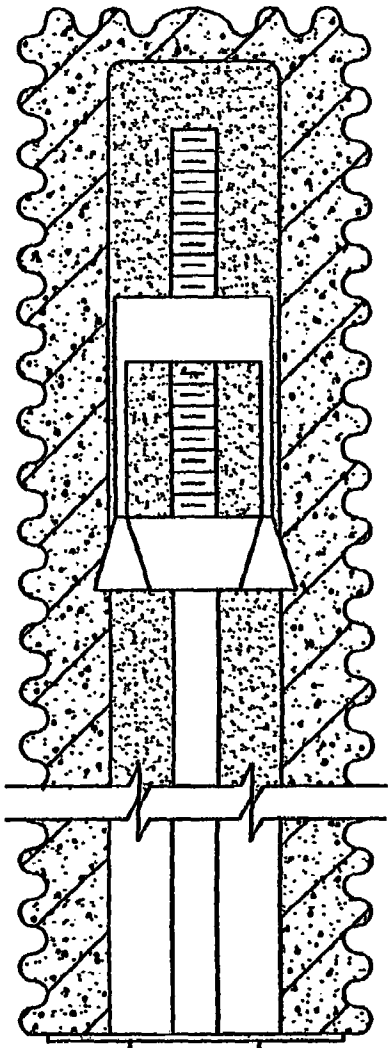
FIG. 8 shows an embodiment of the invention wherein the expansion shell has bails extending from it with wedges on each bail, which expansion shell moves along the lengthwise direction of the threaded section.
Figure 7:
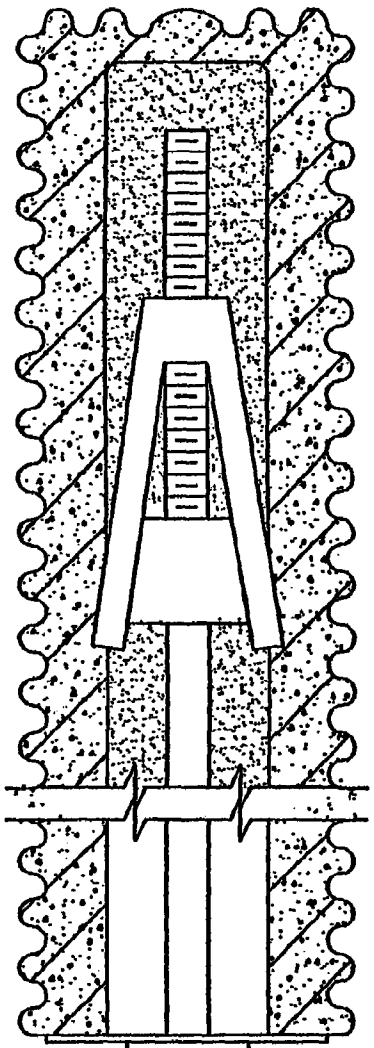
FIG. 7 shows an embodiment of the invention wherein the expansion shell moves along the lengthwise direction of the threaded section.
Figure 6:
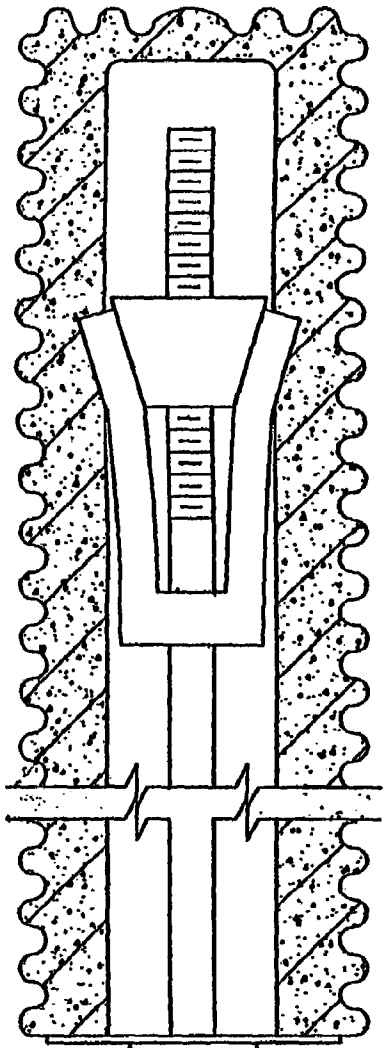
FIG. 6 shows an example of the current art wherein the camming nut moves along the lengthwise direction of the threaded section.

FIG. 8 shows an embodiment wherein the threaded nut portion of the expansion shell moves away from the linearly fixed camming nut as opposed to toward the camming nut. The wedge fingers are reduced to much thinner dimensions for most of their length with their ends expanding to wedge shapes that engage a camming nut which tapers away from the threaded nut portion. The wedge fingers may be reduced down to where they are essentially bails having the needed tensile strength to pull the wedge sections into engagement with the camming nut. Turning the bolt causes the threaded nut portion to move away from the camming nut, pulling the wedge sections into engagement with the camming nut, wedging the mechanical anchoring system into the sides of the hole. The camming nut may be rotationally fixed or it may be allowed to turn freely and held in linear location by a support washer. It may have a conical shape or flat sides.

Figure 9:
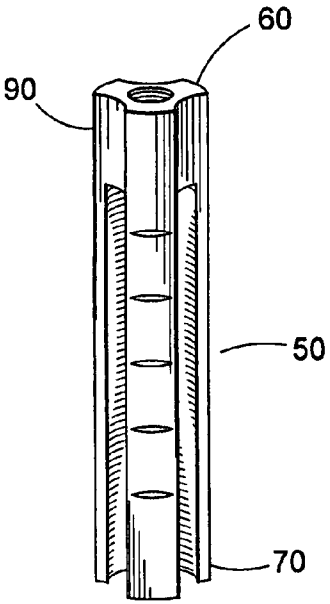
FIG. 9 shows an expansion shell having more than two wedge fingers.

FIG. 9 through 17 illustrate some of these additional embodiments. FIG. 9 shows an expansion shell 50 having greater than two wedge fingers 70, in this case, three wedge fingers 70. Notches 90 in the periphery of threaded nut portion 60 allow the adhesive to flow past threaded nut portion 60 when the mine roof bolt is inserted into a hole in a mine ceiling.

Figure 10:
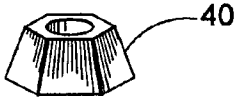
FIG. 10 shows a camming nut having flat sides to engage the wedge fingers.
Figure 11:
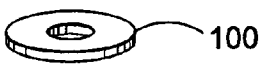
FIG. 11 shows a support washer for maintaining the location of a camming nut.

FIG. 10 shows a camming nut 40 with flat sides as opposed to a smooth conical shape. The number of flat sides must be at least that of the number of wedge fingers 70 on an accompanying expansion shell 50. If it is desired to use a camming nut 40 with flat faces on its incline, it must be able to spin on the bolt portion 10 of the mine roof bolt and match its rate of turn on the bolt portion 10 with that of the accompanying expansion shell 50. This free rotation is allowed by supporting the camming nut 40 with a support washer 100. Support washer 100 is shown in FIG. 11.

Figure 13:
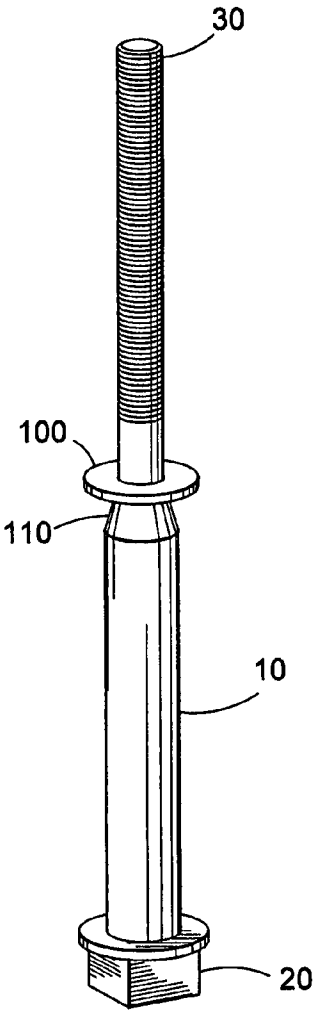
FIG. 13 shows location of a support washer on the taper section.
Figure 12:
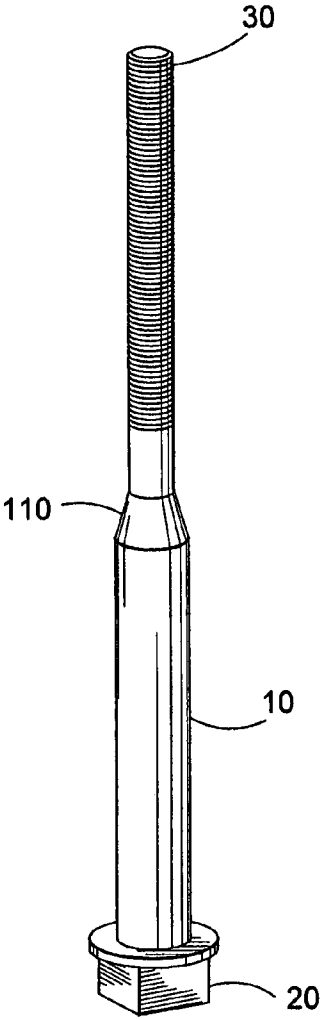

Support washer 100 can be fixed in position along the length of the mine roof bolt with various techniques including welding and crimping support washer 100 to mine roof bolt 10. FIG. 12 and FIG. 13 show another method by which support washer 100 can be held in place. The thread portion 30 in FIG. 12 and FIG. 13 is smaller in diameter than the rest of bolt portion 10. A taper section 110 transitions from smaller to larger diameter sections and the inner diameter of support washer 100 matches some diameter in that transition, probably one closer to the smaller diameter of the machine threads 30 than the larger diameter. This keeps the support washer 100 in a fixed location. A camming nut 40 resting on support washer 100 will be able to turn freely while being held in its longitudinal position by support washer 100.

Figure 14:
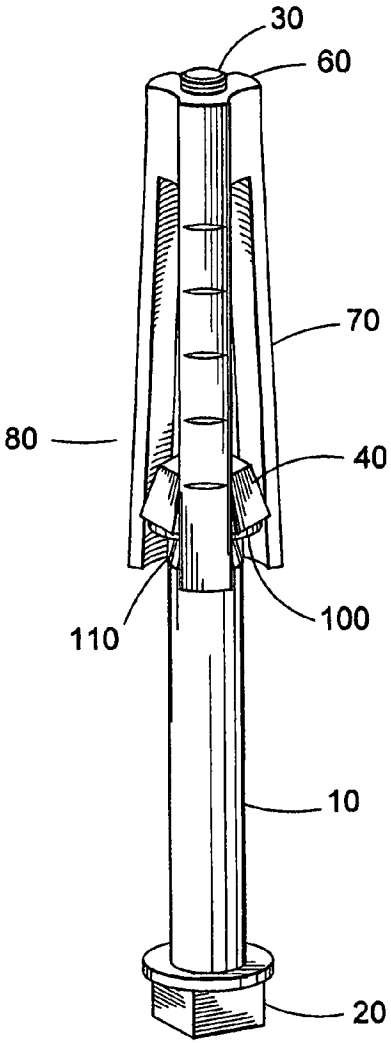
FIG. 14 shows the mine roof bolt apparatus assembled.

FIG. 14 shows support washer 100, camming nut 40 with flats, and expansion shell 50 with three wedge fingers 70 assembled onto bolt 10. Support washer 100 maintains camming nut 40 at a fixed location while allowing camming nut 40 to turn about bolt 10 as expansion shell 50 advances along machine threads 30. Expansion shell 50 is advanced along machine threads 30 by turning bolt portion 10 of bolt assembly 80.

Figure 17:
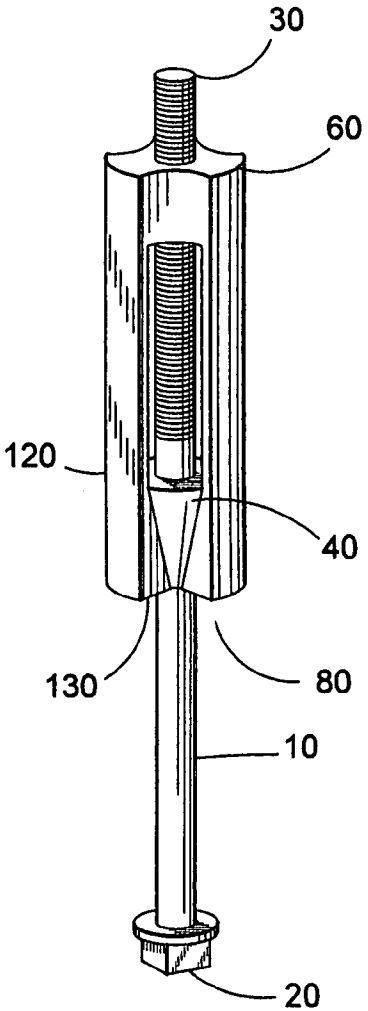
FIG. 17 shows an alternative embodiment of the mine roof bolt apparatus.
Figure 16:
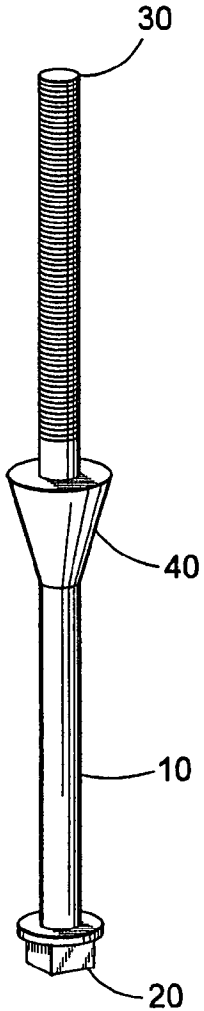
FIG. 16 shows a mine roof bolt having an inverted camming nut.
Figure 15:
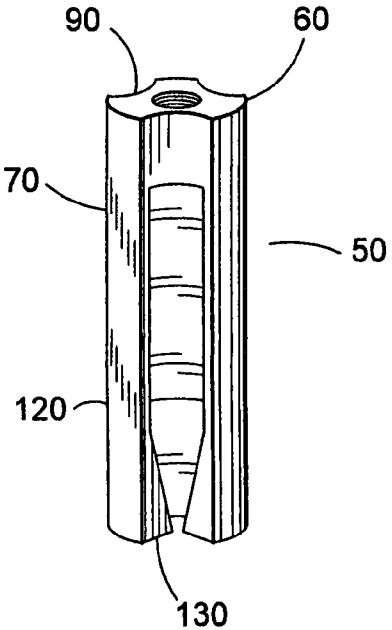
FIG. 15 shows an expansion shell having more than two wedge fingers comprising bail and wedge portions.

FIG. 15 through FIG. 17 illustrate another embodiment which is a further development of the embodiment illustrated in FIG. 8. FIG. 15 shows expansion shell 50 having more than two wedge fingers 70 wherein the wedge fingers 70 are reshaped to work in tension as opposed to compression. Notches 90 in threaded nut portion 60 allow adhesive to flow past threaded nut portion 60 as bolt assembly 80, seen in FIG. 17, is inserted into a mine roof hole. In this embodiment, wedge fingers 70 have a bail section which is reduced down to bails 120 and a wedge section at the end which flair to a wedge 120. In this embodiment, camming nut 40 is fixed along the length of bolt portion 10, but its largest diameter is nearest machine threads 30 while its smallest diameter is directed toward the driven end having means of turning 20 attached. The orientation of camming nut 40 for this embodiment can be seen in FIG. 16 and the interrelation of expansion shell 50 and its wedges 130 with camming nut 40 may be seen in FIG. 17.

To install bolt assembly 80 of FIG. 17, it is inserted upward into a mine roof hole and driven at the means for turning 20 to advance threaded nut portion 60 along machine thread 30. In this case, threaded nut portion 60 moves away from camming nut 40 and bails 120 pull wedges 130 into engagement with camming nut 40 which forces wedges 130 out. The resulting anchoring effect may be seen by referring back to FIG. 8.

In one embodiment, the quantity of machine threads 30 between the threaded nut portion 60 of the expansion shell 50 and the camming nut 40 serve as a timer. The combination of a driver operating at a typical speed with the selected quantity of machine threads 30 results in the expansion shell 50. traveling the needed distance in a predetermined amount of time.

Additional embodiments of the apparatus and method are shown in FIG. 18 through FIG. 23. These embodiments comprise a camming nut 40 that can slide along the length of the machine threads 30 but eventually seat in a fixed location to activate the anchoring effects of the expansion shell 50. In these embodiments, the camming nuts 40 can actually be carried by the expansion shells 50.

Figure 21:
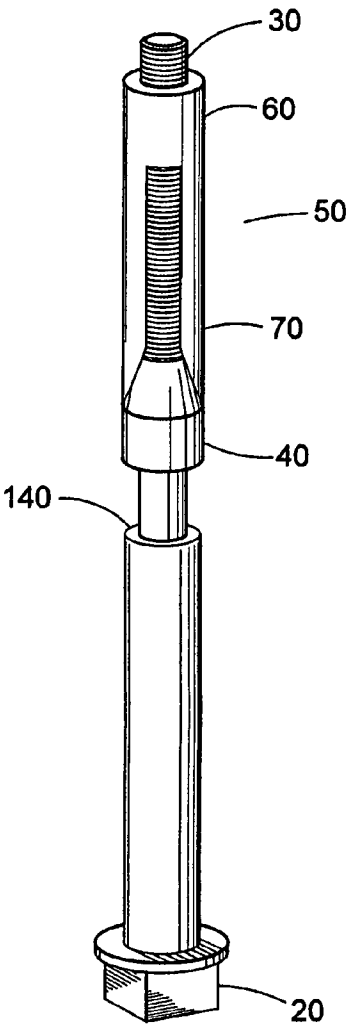
FIG. 21 shows an expansion shell threaded onto a mine roof bolt and holding a camming nut above, the shoulder, its eventual seated location.
Figure 19:
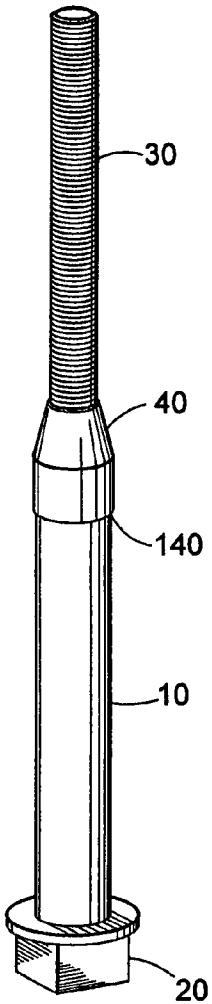
FIG. 19 shows a mine roof bolt having a shoulder at the base of the threads and a camming nut resting on the shoulder.
Figure 18:
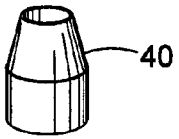
FIG. 18 shows a camming nut with a smooth inner diameter.

FIG. 18 shows a camming nut 40 having at least some portion of its outer diameter tapered to provide a wedging, or camming, effect and having a smooth inner diameter. This smooth inner diameter is sized for a slip fit over the outer diameter of machine threads 30 on bolt portion 10 as shown in FIG. 19. The machine threads 30 of bolt portion 10 have a smaller diameter than the shaft of the bolt portion 10 and this creates a shoulder 140 where machine threads 30 end. This shoulder 140 provides a means for seating camming nut 40 on the bolt portion 10 of the mine roof bolt, also illustrated in FIG. 19. The camming nut 40 in FIG. 19 has slid down over machine threads 30 and stopped, or seated, on shoulder 140. While FIG. 19 and FIG. 21 show the stopping point of shoulder 140 directly after machine threads 30, the stopping point may be located at other locations along the length of bolt portion 10 and other means may be used to stop camming nut 40. FIG. 12 and FIG. 13, for example show taper section 110 stopping support washer 100. Taper section 110 could just as easily stop camming nut 40 for the current embodiment of apparatus and method. Another embodiment would be to slide camming nut 40 over machine threads 30 to rest on shoulder 140 before inserting mine roof bolt 80 into the bore hole. Camming nut 40 would maintain its position by merely resting on shoulder 140 while expansion shell 50 advances to camming nut 40.

Figure 20:
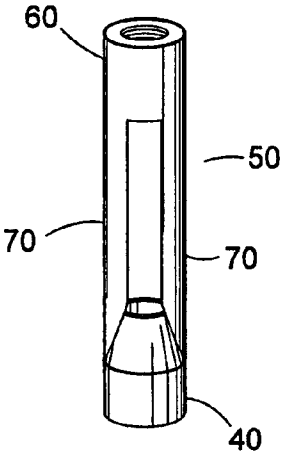
FIG. 20 shows an expansion shell holding a camming nut.

FIG. 20 shows an expansion shell 50 holding a camming nut 40. The expansion shell 50 has two wedge fingers 70. The taper on the outer diameter of camming nut 40 is slight enough that simple friction maintains camming nut 40 in wedge fingers 70 of expansion shell 50. Expansion shell 50 has a threaded nut portion 60 which has machine threads complimentary to machine threads 30 on bolt port 10.

Figure 5:
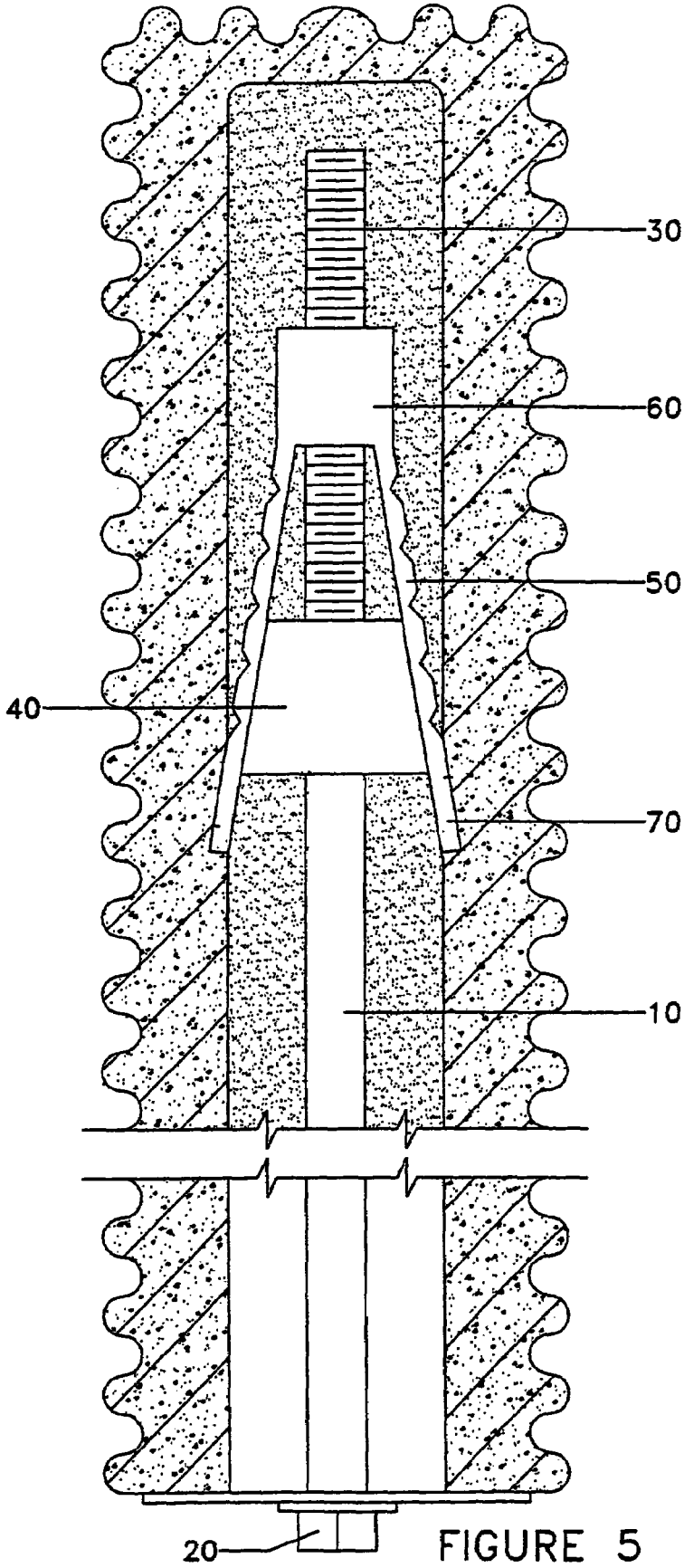
FIG. 5 shows a mine roof bolt of an embodiment of the invention anchored in a hole.

FIG. 21 shows the assembly of expansion shell 50 and camming nut 40, as illustrated in FIG. 20, threaded onto machine threads 30 of bolt portion 10. Camming nut 40 is carried suspended above shoulder 140 until mine roof bolt assembly 80 is placed into a bore hole and turned. This advances the combination of expansion shell 50 and camming nut 40 down along machine threads 30 until camming nut 40 seats on shoulder 140. From the moment of the seating of camming nut 40, bolt assembly 80 works very similarly to the previous discussed and disclosed embodiments. Camming nut 40 is now fixed, while expansion shell 50 advances along machine threads 30. This spreads wedge fingers 70 which lodge and anchor into the sides of the bore hole. FIG. 5 shows the resulting anchored bolt with wedge fingers 70 lodged into the walls of the bore hole.

Figure 23:
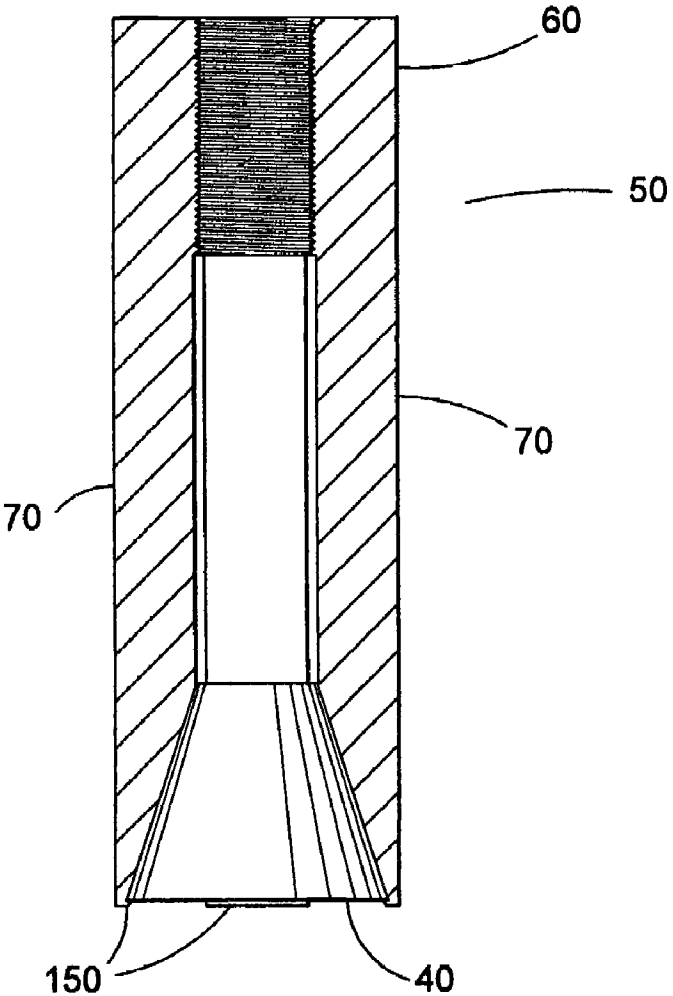
FIG. 23 is a sectional view of FIG. 22 showing the wedge only shape of the camming nut and camming nut retainers on the wedge fingers.
Figure 22:
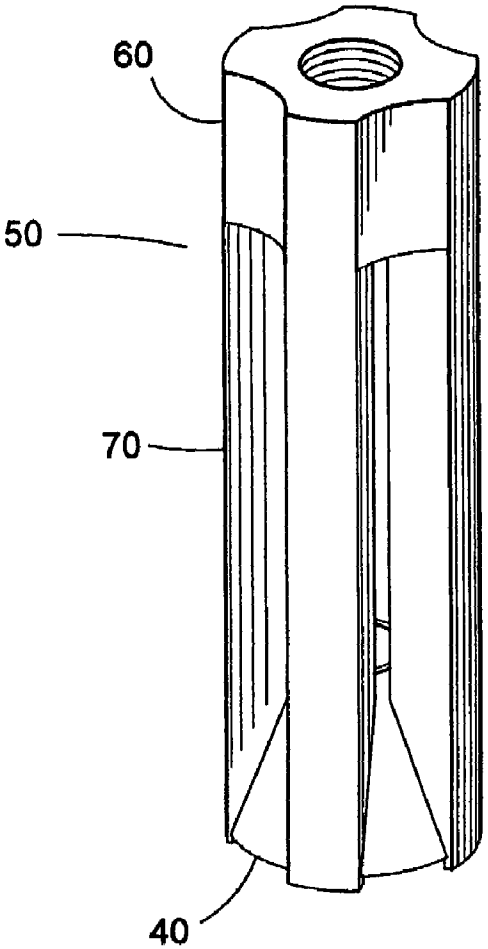
FIG. 22 shows an expansion shell having four wedge fingers and holding a camming nut.

Additional embodiments may be seen in FIG. 22 and FIG. 23. FIG. 22 shows an expansion shell 50 having more than two wedge fingers 70. This expansion shell 50 is also holding a camming nut 40. In this embodiment, camming nut 40 has a taper along the entire length of its outer diameter so that its. largest and smallest outer diameters occur right at each opposing end. Camming nut 40 is more visible in FIG. 23 which is a sectional view of FIG. 22. Also visible are retainers 150 on wedge fingers 70. Retainers 150 are located near the free ends of wedge fingers 70 and lodge behind camming nut 40 when it is inserted into expansion shell 50. Retainers 150 holds camming nut 40 more securely.

I claim:

1. A mine roof bolt comprising:

(a) a shaft portion having machine threads on one end of said shaft and a camming nut stop located on said shaft portion;

(b) a camming nut having an inner diameter sized to slide over said machine thread; and (c) an expansion shell having a threaded nut with a plurality of wedge fingers extending from the outer perimeter of said threaded nut, said wedge fingers being generally parallel to the axis of said threaded nut and having means to carry said camming nut when said camming nut is inserted in between said wedge fingers.

2. The mine roof bolt of claim 1, wherein;

the circumference of said camming nut tapers from a smaller circumference at a first end to a larger circumference somewhere along its length.

3. The mine roof bolt of claim 1, wherein;

the circumference of said camming nut tapers from a smaller circumference at a first end to a larger circumference at a second end.

4. The mine roof bolt of claim 1, wherein;

said means to carry said camming nut comprises friction between said camming nut and said wedge fingers.

5. The mine roof bolt of claim 1, wherein;

said means to carry said camming nut comprises retainers on said wedge fingers.

6. The mine roof bolt of claim 1, wherein;

said expansion shell features two said wedge fingers extending from the outer perimeter of said threaded nut.

7. The mine roof bolt of claim 1, wherein;

said expansion shell features greater than two said wedge fingers extending from the outer perimeter of said threaded nut.

8. The mine roof bolt of claim 1, wherein;

said threaded nut features a reduced cross-section in the portions of said threaded nut which do not feature wedge fingers attached thereto.

9. The mine roof bolt of claim 8, wherein;

said threaded nut is notched in its circumference at the portions of said threaded nut which do not feature wedge fingers attachments.

10. The mine roof bolt of claim 1 wherein:

said camming nut stop is a shoulder formed when said shaft portion has a smaller diameter at said machine thread end and a larger diameter at the opposite end.

11. The mine roof bolt of claim 1 wherein:

said camming nut stop is formed when said shaft portion has a smaller diameter at said machine thread end and a larger diameter at the opposite end and a taper is formed to transition between said diameters.

12. The mine roof bolt of claim 1 wherein;

said camming nut stop is a support washer.

13. A method of anchoring a roof bolt in the roof of an underground mine comprising:

(a) drilling a hole into said roof of said underground mine;

(a) inserting into said hole, a roof bolt assembly comprised of:

(i) a mine roof bolt, threaded on one end, and having a camming nut stop along its shaft, (ii) a camming nut having an inner diameter sized to slide over said threads on said bolt, and (iii) a threaded expansion shell threaded onto said threaded mine roof bolt, said expansion shell carrying said camming nut, (b) turning said threaded mine roof bolt so as to cause said threaded expansion shell to move along said threaded mine roof bolt and carry said camming nut to said camming nut stop, whereupon said camming nut is urged into said expansion shell causing said expansion shell to open and engage the adjacent rock formations of said mine roof.

14. The method of claim 13, wherein:

(a) prior to inserting said mine roof bolt, frangible pouches of adhesive constituent are inserted into said hole, and (b) the insertion and turning of said threaded mine roof bolt breaks said frangible pouches and mixes said adhesive constituents.

15. A method of anchoring a bolt in a bore hole as set forth in claim 13 which further includes;

(a) having a specified quantity of threads on said bolt, (b) having a predetermined distance between said fingers and said camming nut stop, and (c) turning said bolt at a selected rate such that the time required to stop said camming nut on said camming nut stop and engage said expansion shell onto said camming nut and cause said fingers to expand and engage the sides of said bore hole, is predetermined.

16. A method of anchoring a bolt in a bore hole comprising the steps of:

(a) threadedly engaging to the end of the bolt for axial movement thereon, an expansion shell having a plurality of longitudinally extending fingers, (b) positioning a camming nut in said expansion shell with said camming nut surrounded by said longitudinally extending fingers, (c) moving said expansion shell and said camming nut on said bolt, by rotation of said bolt, to a camming nut stop located on said bolt, said camming nut stop halting said camming nut and causing said fingers on said expansion shell to expand and anchor in said bore hole.

17. A method of anchoring a bolt in a bore hole as set forth in claim 13 which further includes;

(a) having a specified quantity of threads on said bolt, (b) having a predetermined distance between said fingers and said camming nut stop, and (c) turning said bolt at a selected rate such that the time required to stop said camming nut on said camming nut stop and engage said expansion shell onto said camming nut and cause said fingers to expand and engage the sides of said bore hole, is predetermined.

18. A method of anchoring a bolt in a bore hole as set forth in claim 16 which includes;

positioning a frangible container of an epoxy adhesive and bonding material in the bore hole ahead of said expandable shell;

rotating said bolt within said bore hole to effect breakage of said frangible container and mixing of said epoxy adhesive material in said bore hole, and;

moving said expansion shell along said bolt to expand the fingers of said expansion shell in said bore hole to anchor said bolt.

* * * * *